US005806439A

United States Patent [19]

Fitts, Sr.

[11] Patent Number: 5,806,439

[45] Date of Patent: Sep. 15, 1998

[54] TRANSPORT SYSTEM FOR AUTOMATIC TELLER MACHINES

[75] Inventor: John E. Fitts, Sr., Gaston, S.C.

[73] Assignee: Concept Unlimited Inc., Gaston, S.C.

[21] Appl. No.: 838,940

[22] Filed: Apr. 23, 1997

[51] Int. Cl.[6] ..... G07G 5/00; E05G 1/00

[52] U.S. Cl. ..... 109/24.1; 312/319.7; 109/50; 109/45; 109/47

[58] Field of Search ..... 109/24.1, 50, 45, 109/47, 48; 414/277, 282, 749; 312/334.24, 334.25, 334.27, 331, 319.5, 319.7, 350; 902/30–35

[56] References Cited

U.S. PATENT DOCUMENTS

| | | | |
|---|---|---|---|
| 840,061 | 1/1907 | Hofman | 312/334.25 |
| 1,077,686 | 11/1913 | Duffy | 312/331 |
| 3,028,209 | 4/1962 | Hinkel et al. . | |
| 3,746,148 | 7/1973 | Hilger et al. | 414/277 |
| 3,869,047 | 3/1975 | Keene et al. . | |
| 4,216,866 | 8/1980 | Fahey et al. | 414/282 |
| 4,235,491 | 11/1980 | Korber et al. . | |
| 4,399,755 | 8/1983 | Wiedmann . | |
| 4,457,492 | 7/1984 | Lahti . | |
| 4,497,261 | 2/1985 | Ferris et al. . | |
| 4,513,670 | 4/1985 | Berman . | |
| 4,557,352 | 12/1985 | Tschappat, Jr. . | |
| 4,558,650 | 12/1985 | Berman . | |
| 4,569,294 | 2/1986 | Beattie et al. . | |
| 4,577,562 | 3/1986 | Berman . | |
| 4,603,643 | 8/1986 | Couvrette . | |
| 4,649,832 | 3/1987 | Hain et al. . | |
| 4,681,044 | 7/1987 | Dallman . | |
| 4,796,515 | 1/1989 | Dry . | |
| 4,813,475 | 3/1989 | Couvrette . | |
| 4,856,437 | 8/1989 | Trucksess . | |
| 5,035,171 | 7/1991 | Gottling et al. . | |
| 5,036,779 | 8/1991 | Capraro . | |
| 5,144,883 | 9/1992 | Muller . | |
| 5,215,363 | 6/1993 | Warwick, III . | |
| 5,222,445 | 6/1993 | Capraro . | |
| 5,299,511 | 4/1994 | Dallman et al. . | |
| 5,331,901 | 7/1994 | Avery | 414/749 |
| 5,440,999 | 8/1995 | Dallman et al. . | |

FOREIGN PATENT DOCUMENTS

| | | | |
|---|---|---|---|
| 2223534 | 4/1990 | United Kingdom | 109/45 |

*Primary Examiner*—Darnell M. Boucher
*Attorney, Agent, or Firm*—Michael A. Mann

[57] ABSTRACT

The present invention is a transport system for an automatic teller machine (ATM). The transport system comprises a motor-driven mechanism and a pair of bearing assemblies. The ATM is positioned within a housing and moves between a retracted position and an extended position by the operation of the motor-driven mechanism. The ATM is supported within the housing by a frame that has a chain attached to its side. A motor connected to the housing and having a motor-driven sprocket engages the chain, thus moving the ATM relative to the housing. An idler sprocket is also provided that is used to define the chain path so that multiple teeth of the motor-driven sprocket engage the chain. Each bearing assembly comprises a channel fixed to the base of the housing. A bearing comprising a block with a plurality of slots is positioned within the interior of the channel. A plurality of rods are freely positioned within the slots and carry a rail that extends through a gap in the channel and a slot within the floor of the housing to support the frame of the ATM. When the ATM is moved between its two positions by the operation of the motor, the ATM moves relative to the housing a predetermined distance, while the bearing moves relative to both the ATM and the housing only one-half of this predetermined distance.

18 Claims, 4 Drawing Sheets

10
90
80
88
84
86
92
12
82
100
26
22
14
62
60
20
66
5
24
16
36
64
38
36
30
40
48
70
70
34
32
46
50
5
18

10
12
14
16
18
20
22
24
26
30
32
34
36
38
40
46
48
50
60
62
64
66
80
82
90
92
100

TRANSPORT SYSTEM FOR AUTOMATIC TELLER MACHINES

BACKGROUND OF THE INVENTION

1. Field of the Invention

The present invention relates generally to kiosks housing automatic teller machines (ATMs). In particular, the present invention relates to a mechanism for moving the ATM out of the kiosk so that it can be serviced and back into the kiosk after servicing is complete.

2. Discussion of Background

Automatic teller machines (ATMs) and, more recently, automatic loan machines (ALMs), have made it more convenient for consumers to take care of their routine banking needs. ATMs are frequently housed in small buildings or kiosks up to which a consumer can walk or drive. The consumer then operates the ATM by pressing a series of buttons in accordance with the machine's instructions. Consumers may obtain cash, make deposits, check on balances, obtain a consumer loan, etc. These ATMs must be serviced periodically, which includes reloading them with cash, retrieving the deposits, changing printer ribbons, routine maintenance and repair. Servicing of the ATMs is complicated by the orientation of the ATM with respect to the kiosk. Because the kiosks are narrow, typically occupying an "island" between drive-through banking lanes, and because the ATMs are positioned to be operated by users from a long side, the back of the ATM inside the kiosk is against the opposing long side wall. Servicing the ATM is done inside the kiosk, partly for security and partly to avoid tying up the next lane to the rear of the kiosk. Servicing also requires gaining access to the back of the ATM from inside the kiosk. Consequently, servicing an ATM requires either that it be moved through a hole in the wall of the kiosk to make room behind it in the kiosk, or that it be rotated to turn its back to someone standing beside the ATM and in the kiosk. The ATM is a heavy piece of equipment, typically weighing several thousand pounds. Consequently, a number of systems have been designed to move it more easily. These are generally referred to as transport systems.

For example, the transport systems described by Dallman, et al. in U.S. Pat. No. 5,440,999 include several approaches to moving an ATM between extended and retracted positions, including two designs based on the use of cable. The cable systems are complicated and involve multiple cables and pulleys. Another of the designs uses a rack and pinion arrangement.

However, there remains a need for an ATM transport system that is simple to operate, durable, effective, and easily manufactured.

SUMMARY OF THE INVENTION

According to its major aspects and broadly stated, the present invention is a transport system for an automatic teller machine (ATM). The ATM is positioned in a housing or kiosk and moves relative to this housing between a retracted or operating position and an extended or servicing position. In a preferred embodiment, the transport system comprises two bearing assemblies and a motor driven mechanism for moving the ATM between its retracted and extended positions.

The ATM is supported by a frame and is positioned above the stationary floor of the housing. The bearing assemblies are carried beneath the floor of the housing proximate to either side of the frame and extend through a slot in the floor to support the movable frame and ATM. Each bearing assembly comprises a channel fixed to the base of the housing (which can be the concrete foundation) with a bearing slidably mounted therein. Positioned on top of the bearing is an I-shaped rail having a top and bottom flange connected together by a section. The bottom flange of the rail engages the bearing and moves relative to the stationary channel and floor of the housing, while the section extends through the channel and the slot in the floor. The top flange positioned above the channel and the floor of the housing is connected to the frame supporting the ATM, so that when the rail moves relative to the stationary channel and bearing, the ATM moves relative to the housing.

The motor-driven mechanism of the present invention comprises a chain connected to the frame supporting the ATM and a motor carried by the housing, where the motor has a motor-driven sprocket engaging the chain. The chain extends approximately the length of the frame and is fixed relative to the frame. In other words, there is a single length of chain that extends from one end of the frame to the other. While the chain is fixed at one end, there is an adjustment device on the other end for tightening the chain. The motor driven mechanism further comprises an idler sprocket which also engages the chain. The idler sprocket is offset from the motor-driven sprocket so that the chain makes an arc about the motor-driven sprocket, thus engaging more teeth of the sprocket than if the chain was fed straight across the motor-driven sprocket. To make the arc about the motor-driven sprocket, the path of the chain goes over the top of the motor-driven sprocket and then around the bottom of the idler sprocket, thus assuring a positive grip by the motor-driven sprocket on the chain.

Each bearing comprises a block having a plurality of slots extending therethrough, with each having a rod freely positioned therein. The bearing is positioned within the channel such that as the rail moves relative to the bearing, the bearing moves relative to the channel. When the ATM moves relative to the housing, the rail moves relative to the channel for a predetermined distance (the same distance the ATM is moved), while the bearing moves approximately one-half of this predetermined distance.

When the ATM is moved to its extended position, the ATM is cantilevered out of the housing, such that the rails are cantilevered within the channels and thus are supporting the total weight of the ATM. In this arrangement, the tops of the channels prevent the rails from escaping the channels; however, the rails exert a greater force against the tops of the channel, proportional to the distance the ATM is moved out of the housing. This increase in force increases the frictional resistance between the two structures. To reduce this frictional resistance, roller bearings are provided on the back end of the bottom flange of each rail to facilitate the movement of the rails within the channels when the ATM is cantilevered out of the housing.

An important feature of the present invention is the arrangement of the motor-driven sprocket and the idler sprocket. This arrangement and the fact that the chain is fixed relative to the frame permits multiple teeth of the motor-driven sprocket to engage the chain, thus assuring that there is no slippage between the chain and the sprockets. In addition, it assures that no one tooth of the motor-driven sprocket takes on the total force for moving the ATM, which would break one tooth more readily than if several teeth are engaged. Furthermore, the chain and sprocket arrangement allows some flexibility and deviation in the alignment between the two, without significantly effecting the performance of the system.

Another feature of the present invention is the bearing which comprises the block and rods. The rods are freely positioned within the block, so that the block merely functions as a device to keep the rods in spaced relation. During the installation of the bearing assembly the bearing is aligned between the channel and rail, and it maintains this position relative to the ATM and housing, even after the ATM has been moved between its extended and retracted position numerous times. This basic design alleviates the need for a complex linear bearing, thus significantly reducing the cost of manufacturing the transport system. In addition, when using commercial linear bearings, the bearings much be aligned parallel to each other, while the present design allows for some deviation without affecting the operation of the bearing assemblies.

Yet another feature of the bearing, which is an important feature of the present invention, is its length of travel. When the ATM is moved relative to the housing, the bearing moves approximately one-half of the distance the ATM moves. This results because the bearing moves relative to both the rail carrying the ATM and to the channel. By reducing its travel distance, the repetitive wear and tear on the bearing rail and channel is reduced.

Still another feature of the present invention are the roller bearings carried on the back end of the rails. If there is not some device for reducing the frictional resistance between the rails and channel when the ATM is in its extended position, cantilevered out of the housing, it would be almost impossible to move the ATM between these two positions. The roller bearings alleviate this problem and allow the ATM to be moved more easily.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
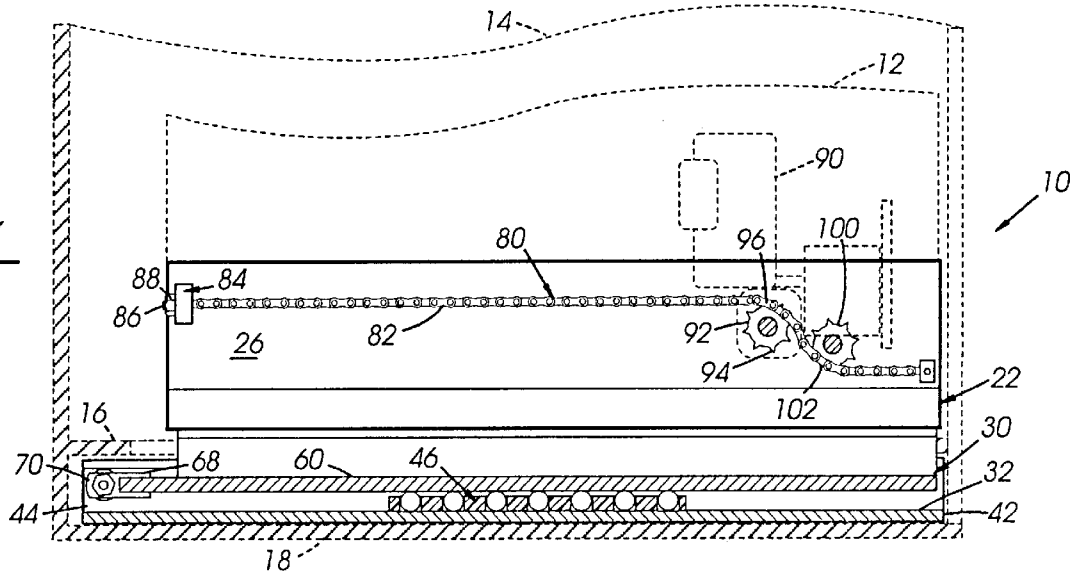
FIG. 1 is a partial side view of a transport system for an ATM with the ATM in a retracted position, according to a preferred embodiment of the present invention.
Figure 2:
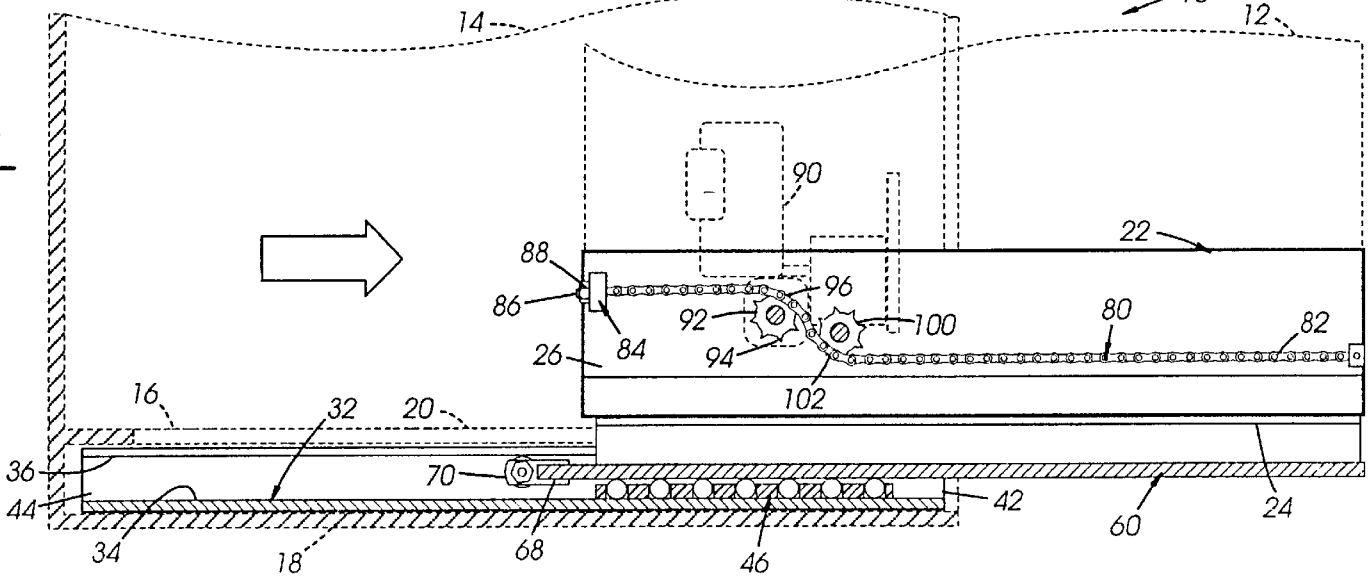
FIG. 2 is a partial side view of a transport system for an ATM with the ATM in an extended position, according to a preferred embodiment of the present invention.
Figure 6:
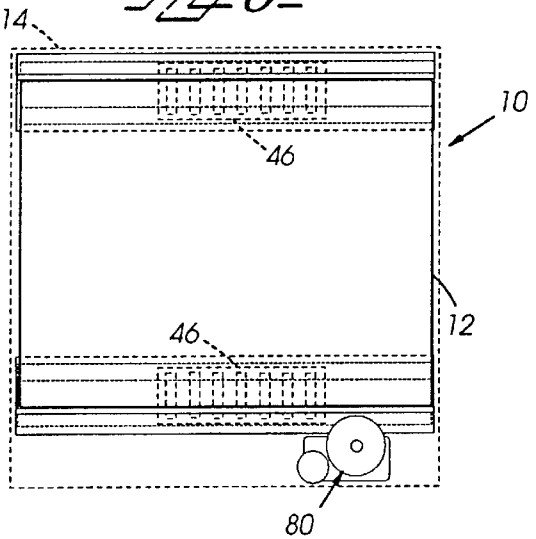
FIG. 6 is a top view of a transport system for an ATM with the ATM in a retracted position, according to a preferred embodiment of the present invention.
Figure 7:
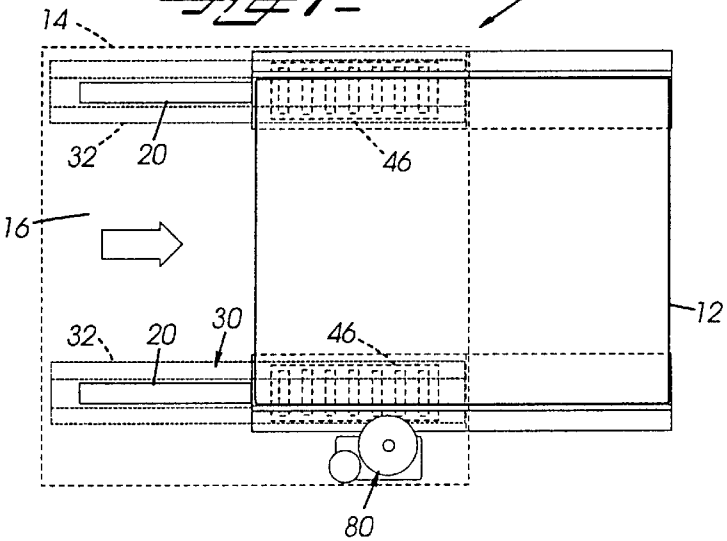
FIG. 7 is a top view of a transport system for an ATM with the ATM in an extended position, according to a preferred embodiment of the present invention.

Referring now to the figures, the present invention is a transport system 10 for an automatic teller machine (ATM) 12, which moves the ATM relative to a housing 14 or kiosk and between a retracted position within the housing 14 (See FIGS. 1 and 6) and an extended position cantilevered out of the housing 14 (See FIGS. 2 and 7). In the following description, the present invention will be described for moving an ATM 12 relative to housing 14; however, it should be understood that transport system 10 may be used for transporting other structures, such as automatic loan machines (ALMs). In addition, housing 14 does not have to completely house the ATM 12, but simply serves as a fixed position to which the relative movement of ATM 12 is measured.

Transport system 10 comprises two bearing assemblies 30 and a motor-driven mechanism 80 which moves the ATM 12 between its retracted and extended positions. In the preferred embodiment, the housing 14 has a floor 16 positioned between bearing assemblies 30 and ATM 12 and fixed so as to be stationary with respect to housing 14. So that the ATM 12 can be moved relative to the stationary housing 14, the bearing assemblies 30 extend through the floor 16 and are connected to the ATM 12, as will be described in more detail below.

In a preferred embodiment, ATM 12 is supported by a frame 22 which has a bottom 24 and at least one side 26. As specifically shown in FIGS. 1 and 2, motor-driven mechanism 80 which moves the ATM 12 between its two positions is attached to the side 26 of frame 22. Motor-driven mechanism 80 comprises a chain 82, a motor 90, and two sprockets, a motor-driven sprocket 92 and an idler sprocket 100. Chain 82 extends approximately the length of the side 26 of frame 22 and is attached at either end. An adjustment device 84 is provided at one end of chain 82 so that it may be tightened, if necessary. It will be recognized that there are several devices that may be used for tightening chain 82, including a bolt 86, nut 88 and hook (not shown) arrangement. Chain 82 is in spaced relation with regard to side 26 of frame 22 so that sprockets 92, 100 may engage chain 82. In addition, chain 82 is fixed relative to side 26 and thus does not operate in a bicycle type fashion with respect to side 26; that is, it is not an "endless" chain but has one end attached to each end of frame 22.

Motor 90 is connected to housing 14 so that it does not move relative to housing 14. Carried by motor 90 is a driving sprocket or motor-driven sprocket 92 which has a plurality of teeth 94 that engage chain 82. In addition, there is an idler sprocket 100 connected to housing 14 which engages chain 82 similar to motor-driven sprocket 92. Idler sprocket 100 and motor-driven sprocket 92 are offset from each other, and chain 82 follows a path so that multiple teeth 94 of motor-driven sprocket 92 engage chain 82, thus preventing slippage and providing a more positive grip. The path of chain 82 extends from one end of frame 22 over the top 96 of motor-driven sprocket 92 and then around the bottom 102 of idler sprocket 100. Having this path, chain 82 is assured of being in contact with multiple teeth 94 of motor-driven sprocket 92 as it forms an arc about it. Furthermore, the ends of chain 82 are not aligned with each other but are offset from each other. In particular, the end of chain 82 closest to motor-driven sprocket 92 is positioned farther away from bottom 24 of frame 22 than the other end of chain 82 closer to idler sprocket 100.

In operation, motor 90 rotates motor-driven sprocket 92 in a clockwise direction to move ATM 12 to its extended position and in a counter-clockwise direction to return the ATM to its retracted position. (The clockwise and counter-clockwise direction are based upon a side view of side 26 of frame 22 with chain 82 thereon.) In either case, idler sprocket 100 rotates in relation to the movement of chain 82.

Those of ordinary skill in the art will recognize that there are several ways to arrange motor-driven sprocket 92 and chain 82 without departing from the spirit and scope of the present invention. Specifically, a derailer like that used on a bicycle could be used. In this case, the chain 82 would also go over the top 96 of motor-driven sprocket 92 and then under idler sprocket 100, therefore engaging multiple teeth 94 of motor-driven sprocket 92. In this embodiment, it is not necessary for idler sprocket 100 to be connected to housing 14; it may be connected to motor-driven sprocket 92 so long as idler sprocket 100 does not move relative to motor 90 or housing 14. Additionally, a derailer could also serve the function of an adjustment device that tightens chain. For instance, a spring within the derailer can be used to impart a force between idler sprocket 100 and motor-driven sprocket 92, thus maintaining a predetermined tension in chain 82, dependent on the spring rate of the spring. Finally, it will be recognized that several types of motors may be used to turn motor-driven sprocket 92, for example, an electric motor, a hydraulic motor, or even a hand actuated crank that turns motor driven sprocket 92.

When the ATM moves between its retracted and extended positions, frame 22 rides along bearing assemblies 30. Bearing assemblies 30 each comprise a channel 32, a bearing 46, and a rail 60. Channel 32 is C-shaped, having a bottom 34 which extends around to a top 36 which is divided by a gap 38, as specifically shown in FIGS. 3 and 4. Each channel 32 is placed along the base 18 of housing 14 so that each runs parallel to the other and is positioned in spaced relation on either side of frame 22, as shown in FIGS. 6 and 7. The bottom 24 of housing 14 can be part of the actual structure of housing 14, but may also be the foundation on which housing 14 is placed. In either case, channels 32 are secured to the bottom 24 of housing 14 or potentially to its concrete foundation, so that channels 32 will not move relative to housing 14.

Bearings 46 are placed within the interior 40 of channels 32, so that each may slide or roll therein. Each bearing 46 comprises a plurality of rods 48 which are maintained in spaced relation by a PVC (polyvinyl chloride) block 50, which has a matching number of slots 52. Each rod 48 is placed within a slot 52 in the block so that it is freely positioned therein. In other words, rods 48 are not physically attached to block 50, but slots 52 within block 50 are dimensioned so that each rod 48 may roll freely therein. In addition, the thickness of block 50 is less than the diameter of each rod 48, so that block 50 does not interfere with the rolling motion of rods 48 as each rod 48 contacts the bottom 34 of channel 32 and rail 60, which is positioned on top of rods 48.

Figure 3:
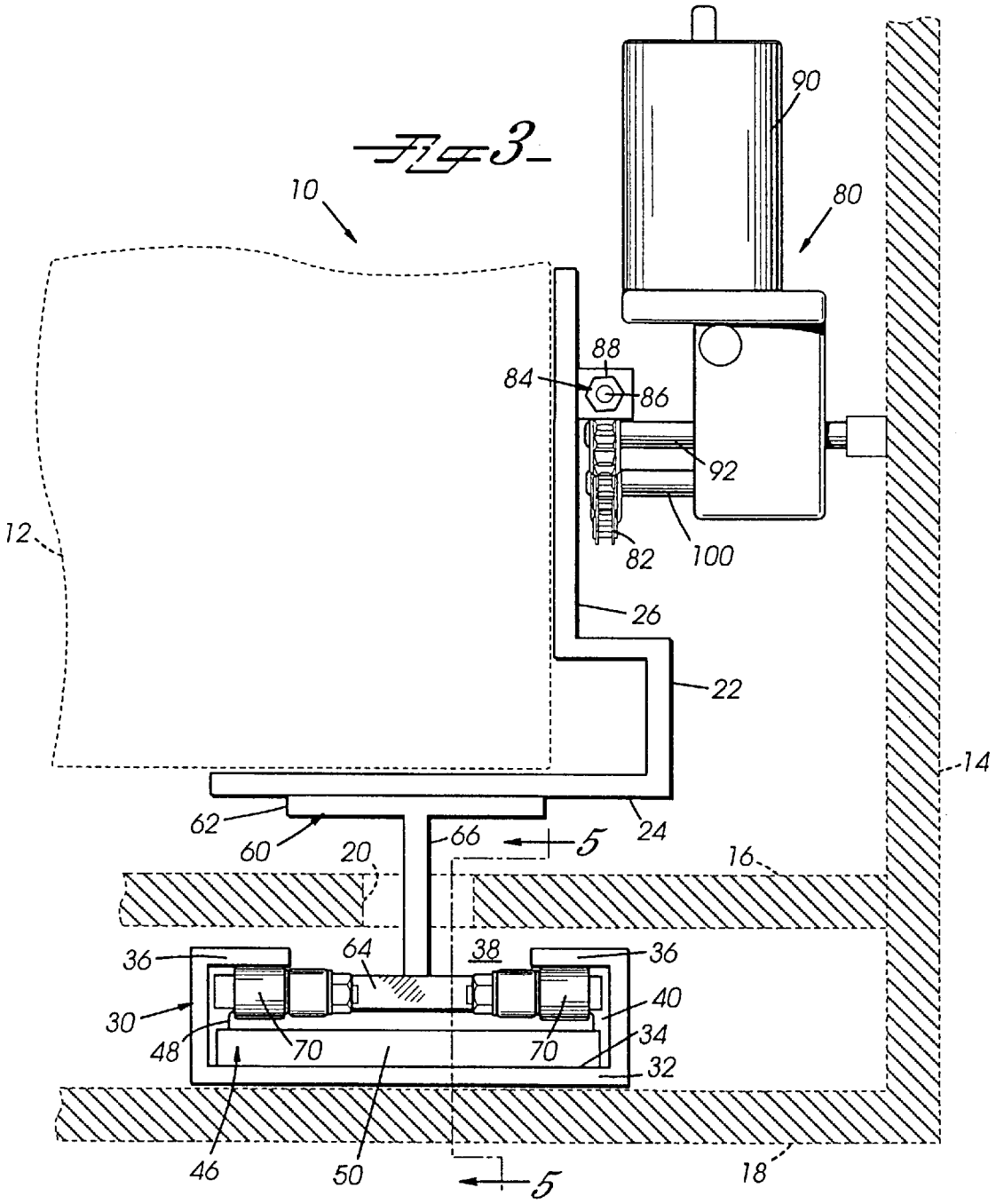
FIG. 3 is rear view of a transport system for an ATM according to a preferred embodiment of the present invention.
Figure 4:
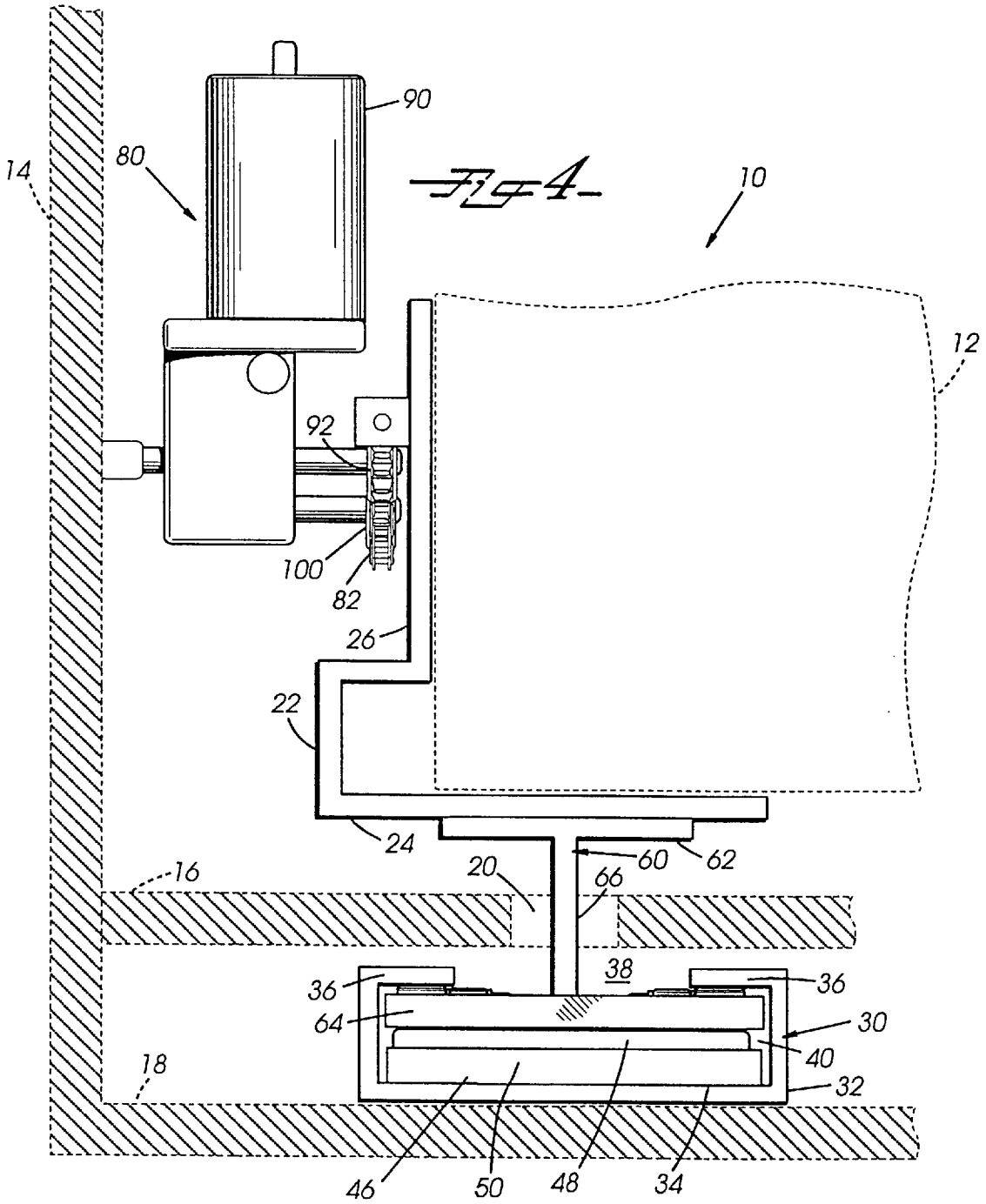
FIG. 4 is a front view of a transport system for an ATM according to a preferred embodiment of the present invention.
Figure 5:
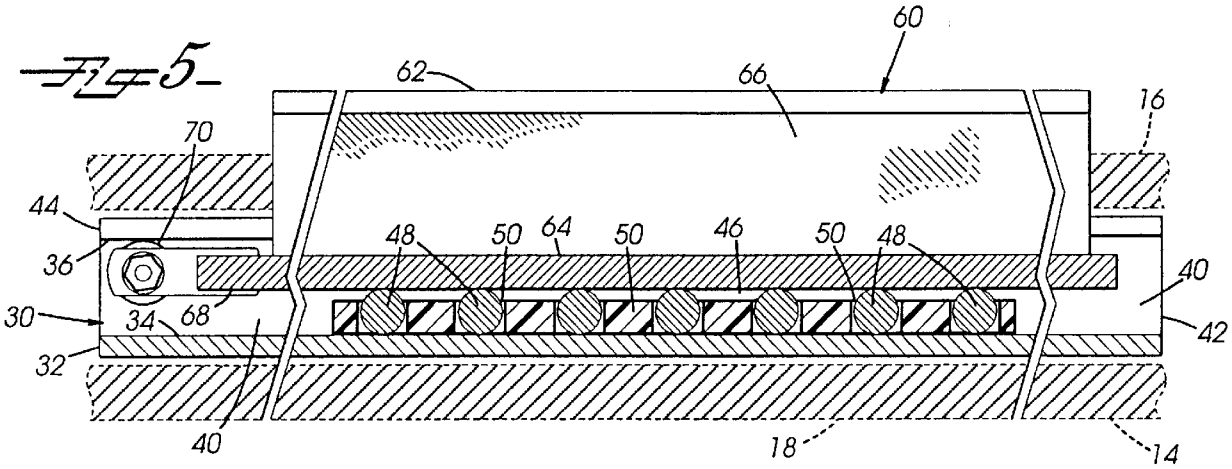
FIG. 5 is a cross-sectional view taken along line 5—5 of FIG. 3 showing a bearing assembly, according to a preferred embodiment of the present invention.

In a preferred embodiment, rail 60 comprises an I-shaped beam having a top flange 62 and a bottom flange 64 connected by a section 66 therebetween. Bottom flange 64 of rail 60 is positioned within the interior 40 of channel 32 and rides along the top of rods 48 of bearing 46. Like bearing 46, the width of bottom flange 64 is such that bottom flange 64 cannot fit through gap 38 of channel 32. Channel 32, bearing 46, and bottom flange 64 of rail 60 are positioned below the floor 16 of housing 14, while section 66 of rail 60 extends from bottom flange 64 through gap 38 in channel 32 and through a slot 20 in the floor 16 of housing 14, as best seen in FIGS. 3 and 4. Top flange 62 of rail 60, positioned above the floor 16 of housing 14, is connected to frame 22 supporting ATM 12, so that rail 60 and ATM 12 move together relative to housing 14 and floor 16, which are stationary.

Those of ordinary skill in the art will recognize that the shape of rail 60 may be modified and changed without departing from the spirit and scope of the present invention. For example, the width of top flange 62 and bottom flange 64 may be the same, but they may also be different without significantly affecting the function of rail 60. In addition, top flange 62 does not have to correspond to an I-shaped beam but can merely extend from one side of section 66, or section 66 may be directly connected to frame 22, thus eliminating top flange 62 altogether.

Rail 60 also has a rear end 68 which carries a pair of roller bearings 70. Roller bearings 70 engage the top 36 of channel 32 when ATM 12 is cantilevered out of housing 14, as shown in FIGS. 2 and 7. When ATM 12 is in this position, bottom flange 64 of rail 60 exerts an increasingly greater force against the top 36 of channel 32 as ATM 12 is moved more toward its extended position. The increase in force increases the frictional resistance between the bottom flange 64 and top 36, thus increasing the force necessary to move ATM 12. By using roller bearings 70 the frictional resistance is reduced, thus facilitating the movement of the ATM 12 between its extended and retracted positions.

During installation bearing 46 is positioned within channel 32 approximately midway between its front and rear ends 42, 44, respectively. Bottom flange 64 of rail 60 is then also positioned within channel 32, and frame 22 supporting the ATM 12 is subsequently attached to top flange 62 of rail 60. Once in position, the ATM 12 can be easily moved between its extended and retracted positions. When the ATM 12 is moved, it is typically moved a predetermined distance to its extended position by the operation of motor 90. Rail 60 and frame 22, both connected to ATM 12, move the same predetermined distance. However, bearing 46 moves relative to both rail 60 and channel 32 and thus travels only half of this predetermined distance, as best seen in FIGS. 1 and 2. The reduction in travel distance reduces the wear and tear on bearing assembly 30. In addition, the reduction in movement and simplicity of design of bearing assembly 30 allows bearing assemblies 30 to deviate from their parallel relationship relative to each other without significantly affecting their operation.

It will be apparent to those skilled in the art that many changes and substitutions can be made to the preferred embodiment herein described without departing from the spirit and scope of the present invention as defined by the appended claims.

What is claimed is:

1. A system for moving an ATM, said system comprising:

a frame adapted to support the ATM, said frame having a bottom and a side, said side having a length;

a housing;

a bearing assembly positioned between said bottom of said frame and the housing, so that said frame can move relative to the housing between an extended position and a retracted position;

a chain connected to said side of said frame, said chain in a fixed position relative to said frame;

a motor adapted to be mounted in the housing;

a driving sprocket mounted to said motor, said driving sprocket engaging said chain so that when said driving sprocket rotates by the operation of said motor, said frame moves relative to the housing between said extended position and said retracted position, said motor rotating said driving sprocket in a clockwise direction and a counter-clockwise direction, said frame being moved to said extended position from said retracted position when said driving sprocket rotates in said clockwise direction and to said retracted position from said extended position when said driving sprocket rotates in said counter-clockwise direction.

2. The system as recited in claim 1, further comprising means for tightening said chain.

3. The system as recited in claim 1, wherein said driving sprocket has a plurality of teeth; and wherein said system further comprises an idler sprocket connected to the housing, said idler sprocket offset from said driving sprocket, so that said chain engages multiple teeth of said plurality of teeth of said driving sprocket.

4. The system as recited in claim 1, wherein said driving sprocket has a top; and wherein said system further comprises an idler sprocket connected to the housing, said idler sprocket having a bottom, said chain following a path so that said chain engages said top of said driving sprocket and said bottom of said idler sprocket.

5. The system as recited in claim 1, wherein said chain extends approximately said length of said side of said frame.

6. A system for moving an ATM, said system comprising:

a housing;

a frame adapted to support the ATM, said frame having a bottom;

a bearing assembly positioned between said bottom of said frame and the housing, so that said frame can move relative to the housing between an extended position and a retracted position, said bearing assembly comprising a channel connected to the housing;

a bearing positioned within said channel; and a rail connected to said frame, said rail slidably positioned in said channel on said bearing; and a motor adapted to be carried by the housing, said motor in engagement with said frame so that when said motor operates, said frame moves relative to the housing between said extended position and said retracted positions, wherein the housing has a floor with a slot therein, said floor positioned between said frame and said bearing assembly so that said rail extends through said slot in said floor.

7. A The system as recited in claim 6, wherein said bearing further comprises a plurality of rods and a block.

8. The system as recited in claim 7, wherein said block has a thickness and said rods have a diameter, said diameter of said rods being greater than said thickness of said block.

9. The system as recited in claim 6, wherein said bearing further comprises a block having a plurality of slots extending therethrough; and a plurality of rods, each rod of said plurality of rods positioned in a slot of said plurality of slots.

10. The system as recited in claim 9, wherein said each rod of said plurality of rods is permitted to move and rotate freely within said slot of said plurality of slots.

11. The system as recited in claim 6, wherein said rail comprises an I-shaped beam having a top flange and a bottom flange with a section therebetween, said bottom flange engaging said bearing and said top flange connected to said frame.

12. The system as recited in claim 6, wherein said bearing further comprises a block having a plurality of slots extending therethrough, and a plurality of rods, each rod of said plurality of rods positioned in a slot of said plurality of slots; wherein said rail comprises an I-shaped beam having a top flange and a bottom flange with a section therebetween, said bottom flange engaging said plurality of rods of said bearing and positioned within said channel, said section extending through a gap in said channel, and said top flange connected to said frame.

13. The system as recited in claim 6, wherein said channel has a top; and wherein rail roller bearings are carried thereon, said roller bearings engaging said top of said channel, when said frame is moved relative to the housing.

14. A system for moving an ATM, said system comprising:

a housing;

a frame adapted to support the ATM, said frame having a bottom;

a bearing assembly positioned between said bottom of said frame and the housing, so that said frame can move relative to the housing between an extended position and a retracted position, said bearing assembly comprising:

a channel connected to the housing;

a bearing positioned within said channel; and a rail connected to said frame, said rail slidably positioned in said channel on said bearing;

a chain connected to said side of said frame, said chain in a fixed position relative to said frame;

a motor adapted to be mounted in the housing; and a driving sprocket carried by said motor, said driving sprocket engaging said chain so that when said driving sprocket rotates by the operation of said motor, said frame moves relative to the housing between said extended position and said retracted position.

15. The system as recited in claim 14, wherein said bearing further comprises a block having a plurality of slots extending therethrough, and a plurality of rods, each rod of said plurality of rods positioned in a slot of said plurality of slots; wherein said rail comprises an I-shaped beam having a top flange and a bottom flange with a section therebetween, said bottom flange engaging said plurality of rods of said bearing and positioned within said channel, said section extending through a gap in said channel, and said top flange connected to said frame.

16. The system as recited in claim 14, wherein said driving sprocket has a top; and wherein said system further comprises an idler sprocket connected to the housing, said idler sprocket having a bottom, said chain engaging said top of said driving sprocket and said bottom of said idler sprocket.

17. The system as recited in claim 14, wherein said channel has a top; and wherein said rail comprises a bottom flange and a top flange, said bottom flange having a roller bearing thereon, said roller bearing engaging said top of said channel when said frame is moved relative to the housing and said top flange is connected to said frame.

18. The system as recited in claim 14, wherein said bearing further comprises a block having a plurality of slots extending therethrough and a plurality of rods, each rod of said plurality of rods positioned in a slot of said plurality of slots; wherein said rail comprises an I-shaped beam having a top flange and a bottom flange with a section therebetween, said bottom flange engaging said plurality of rods of said bearing and positioned within said channel, said section extending through a gap in said channel, and said top flange connected to said frame; wherein said bottom flange of said rail has a roller bearing thereon, said roller bearing engaging the top of said channel; and wherein when said rail moves relative to said channel a predetermined distance, said bearing moves approximately one-half of said predetermined distance.

* * * * *